US011756717B2

(12) United States Patent
Miyasou

(10) Patent No.: US 11,756,717 B2
(45) Date of Patent: Sep. 12, 2023

(54) COIL COMPONENT

(71) Applicant: TAIYO YUDEN CO., LTD., Tokyo (JP)

(72) Inventor: Nobuyuki Miyasou, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 570 days.

(21) Appl. No.: 16/856,220

(22) Filed: Apr. 23, 2020

(65) Prior Publication Data

US 2020/0343032 A1 Oct. 29, 2020

(30) Foreign Application Priority Data

Apr. 26, 2019 (JP) ..... 2019-086809

(51) Int. Cl.

| | |
|---|---|
| ***H01F 27/02*** | (2006.01) |
| ***H01F 17/00*** | (2006.01) |
| ***H01F 1/147*** | (2006.01) |
| ***H01F 27/255*** | (2006.01) |
| ***H01F 41/04*** | (2006.01) |
| ***H01F 27/28*** | (2006.01) |
| ***H01F 1/20*** | (2006.01) |

(52) U.S. Cl.

CPC ..... *H01F 17/0013* (2013.01); *H01F 1/14766* (2013.01); *H01F 1/20* (2013.01); *H01F 27/027* (2013.01); *H01F 27/255* (2013.01); *H01F 27/2804* (2013.01); *H01F 41/04* (2013.01); *H01F 2027/2809* (2013.01)

(58) Field of Classification Search

CPC .... H01F 17/0013; H01F 1/14766; H01F 1/20; H01F 27/027; H01F 27/255; H01F 27/2804; H01F 41/04; H01F 2027/2809; H01F 1/15366; H01F 1/26; H01F 1/37; H01F 27/292

See application file for complete search history.

(56) References Cited

U.S. PATENT DOCUMENTS

2016/0055955 A1* 2/2016 Park ..... H01F 27/255 336/83

FOREIGN PATENT DOCUMENTS

| | | | | |
|---|---|---|---|---|
| JP | 4214700 B2 * | 1/2009 | ..... | H01F 17/0013 |
| JP | 2017-092505 A | 5/2017 | | |
| JP | 6195256 B2 * | 9/2017 | ..... | H01F 1/36 |

* cited by examiner

*Primary Examiner* — Tuyen T Nguyen

(74) *Attorney, Agent, or Firm* — Pillsbury Winthrop Shaw Pittman, LLP

(57) ABSTRACT

A coil component includes: a laminate including a magnetic portion and an insulator, the insulator having a higher insulation quality than the magnetic portion; a first external electrode; a second external electrode; and a coil conductor provided in the laminate, wherein the coil conductor includes a plurality of conductor patterns each extending along a planar direction perpendicular to the coil axis, the plurality of conductor patterns being separated from each other in the direction of the coil axis, the plurality of conductor patterns include a first conductor pattern and a second conductor pattern, the first conductor pattern contacting with the first external electrode, the second conductor pattern contacting with the second external electrode, and in the planar direction, the insulator is provided between the first conductor pattern and the second external electrode and between the second conductor pattern and the first external electrode.

9 Claims, 8 Drawing Sheets

COIL COMPONENT

CROSS-REFERENCE TO RELATED APPLICATIONS

This application is based on and claims the benefit of priority from Japanese Patent Application Serial No. 2019-086809 (filed on Apr. 26, 2019), the contents of which are hereby incorporated by reference in their entirety.

TECHNICAL FIELD

The present invention relates to a coil component.

BACKGROUND

There are conventional coil components including a base body formed of a magnetic material such as ferrite, an external electrode provided on the surface of the base body, and a coil conductor embedded in the base body and including a plurality of conductor patterns. One example of the coil components is an inductor. An inductor is a passive element used in an electronic circuit. For example, an inductor eliminates noise in a power source line or a signal line. Such a coil component is disclosed in Japanese Patent Application Publication No. 2017-092505.

The base body of the conventional coil component is formed of, for example, a material containing metal magnetic particles. In this case, an insulating film is provided on the surface of the metal magnetic particles so as to cover the metal magnetic particles, thereby preventing an unintended short circuit between the conductor patterns and the external electrode via the metal magnetic particles. However, since the metal magnetic particles have a high electric conductivity, a short circuit will occur if the insulating film covering a metal magnetic particle is broken. Therefore, it is demanded to improve the reliability of insulation in the coil components.

SUMMARY

One object of the present invention is to provide a coil component having an improved reliability of insulation. Other objects of the present invention will be made apparent through the entire description of the specification.

A coil component according to an embodiment of the present invention comprises: a base body including a magnetic portion and an insulator, the magnetic portion containing metal magnetic particles, the insulator having a higher insulation quality than the magnetic portion; a first external electrode provided on a surface of the base body; a second external electrode provided on the surface of the base body; and a coil conductor wound around a coil axis in the base body. The coil conductor includes a plurality of conductor patterns each extending along a planar direction perpendicular to the coil axis, the plurality of conductor patterns being separated from each other in the direction of the coil axis, and the plurality of conductor patterns include a first conductor pattern and a second conductor pattern, the first conductor pattern contacting with the first external electrode, the second conductor pattern contacting with the second external electrode. In the planar direction, the insulator is provided between the first conductor pattern and the second external electrode and between the second conductor pattern and the first external electrode.

The coil component includes the first conductor pattern contacting with the first external electrode and the second conductor pattern contacting with the second external electrode. In the planar direction, the coil component also includes the insulator between the first conductor pattern and the second external electrode and between the second conductor pattern and the first external electrode. The insulator has a higher insulation quality than the magnetic portion. The potential difference between the coil conductor and the second external electrode is largest between the first conductor pattern and the second external electrode, and the potential difference between the coil conductor and the first external electrode is largest between the second conductor pattern and the first external electrode. Therefore, the short circuit is most likely to occur between the first conductor pattern and the second external electrode and between the second conductor pattern and the first external electrode. As described above, the insulator having a higher insulation quality than the magnetic portion is provided between the first conductor pattern and the second external electrode and between the second conductor pattern and the first external electrode, thereby improving the reliability of insulation.

In an embodiment of the present invention, in the planar direction, the coil component may include the insulator between the first external electrode and the plurality of conductor patterns and between the second external electrode and the plurality of conductor patterns. In this arrangement, the insulator is also provided between the first external electrode and the conductor patterns other than the first and second conductor patterns and between the second external electrode and the conductor patterns other than the first and second conductor patterns, thereby preventing or suppressing the short circuit occurring in a larger region between the coil conductor and the first and second external electrodes. This further improves the reliability of insulation in the coil component.

In an embodiment of the present invention, in the planar direction, the insulator may be provided between the magnetic portion and the first external electrode and between the magnetic portion and the second external electrode. This arrangement makes it possible to prevent or suppress the short circuit occurring in a larger region between the coil conductor and the first and second external electrodes, thereby further improving the reliability of insulation in the coil component.

In an embodiment of the present invention, the insulator may be provided between the plurality of conductor patterns in the direction of the coil axis. This arrangement makes it possible to prevent or suppress the short circuit occurring between adjacent conductor patterns via the magnetic portion, thereby further improving the reliability of insulation in the coil component.

In an embodiment of the present invention, the magnetic portion may include interposing regions disposed between adjacent ones of the plurality of conductor patterns in the direction of the coil axis, and in the planar direction, the insulator may be provided between the first external electrode and the interposing regions and between the second external electrode and the interposing regions.

In an embodiment of the present invention, the magnetic portion may include a first cover portion and a second cover portion, the first cover portion being disposed on one side of the coil conductor in the direction of the coil axis, the second cover portion being disposed on another side of the coil conductor in the direction of the coil axis, and in the planar direction, the insulator is provided between the first cover portion and the first external electrode, between the first cover portion and the second external electrode, between the second cover portion and the first external electrode, and between the second cover portion and the second external electrode.

In an embodiment of the present invention, the first external electrode may lie only on a surface of the insulator, except for a portion of the first external electrode contacting with the first conductor pattern, and the second external electrode may lie only on the surface of the insulator, except for a portion of the second external electrode contacting with the second conductor pattern.

In an embodiment of the present invention, in the planar direction, a part of the magnetic portion may be interposed between the insulator and the plurality of conductor patterns. This arrangement makes it possible to reduce the decrease of the volume of the magnetic portion due to the presence of the insulator. Therefore, it is possible to suppress reduction of the saturation flux density and improve the reliability of insulation.

An embodiment of the present invention relates to a circuit board comprising the above coil component.

An embodiment of the present invention relates to an electronic component comprising the above circuit board.

Advantages

According to the present invention, a coil component having an improved reliability of insulation is provided.

DESCRIPTION OF THE EMBODIMENTS

Various embodiments of the present invention will be hereinafter described with reference to the drawings. Elements common to a plurality of drawings are denoted by the same reference signs throughout the plurality of drawings. It should be noted that the drawings do not necessarily appear to an accurate scale for convenience of explanation.

Figure 1:
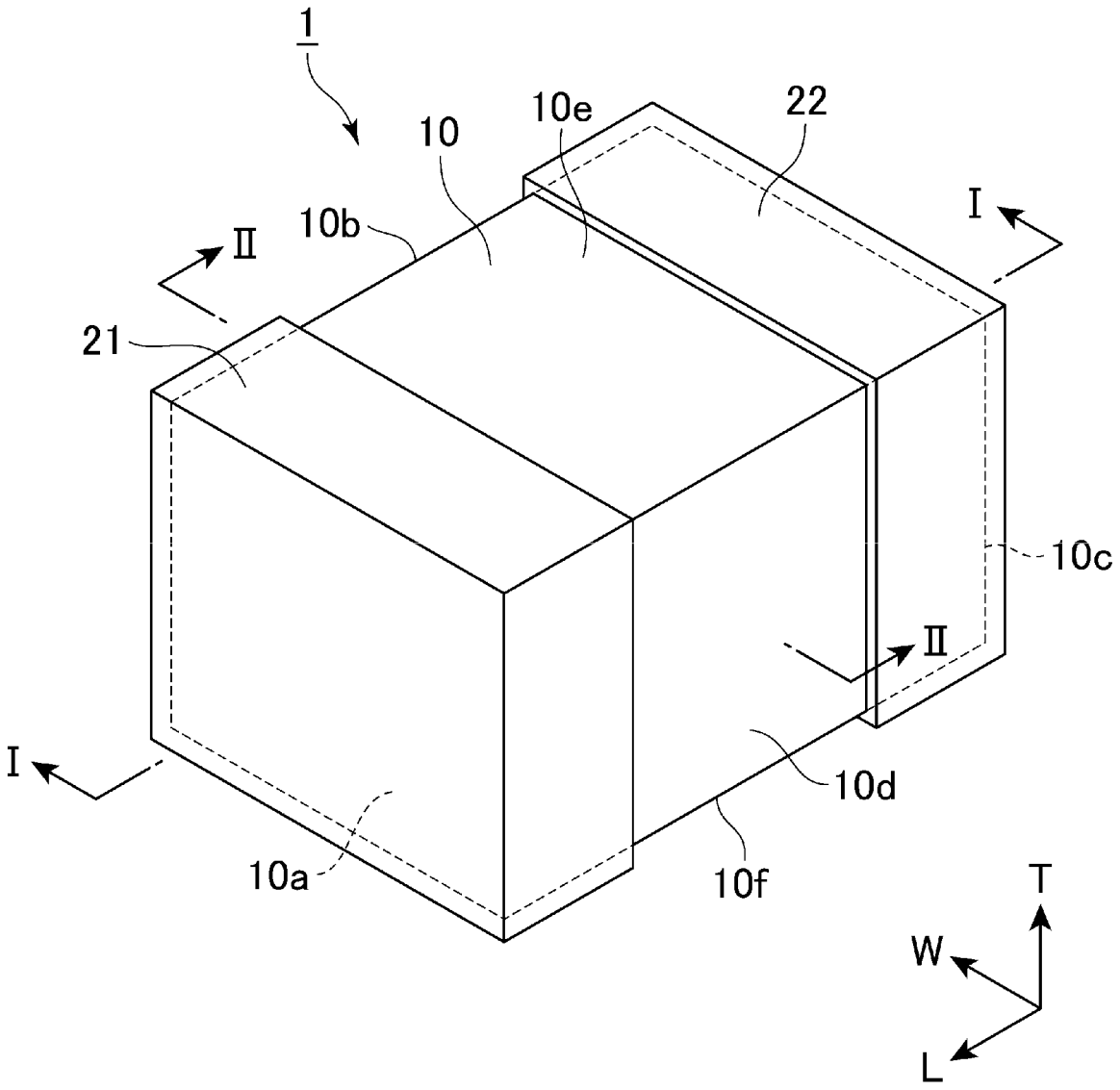
FIG. 1 is a perspective view of a coil component according to one embodiment of the present invention.
Figure 2:
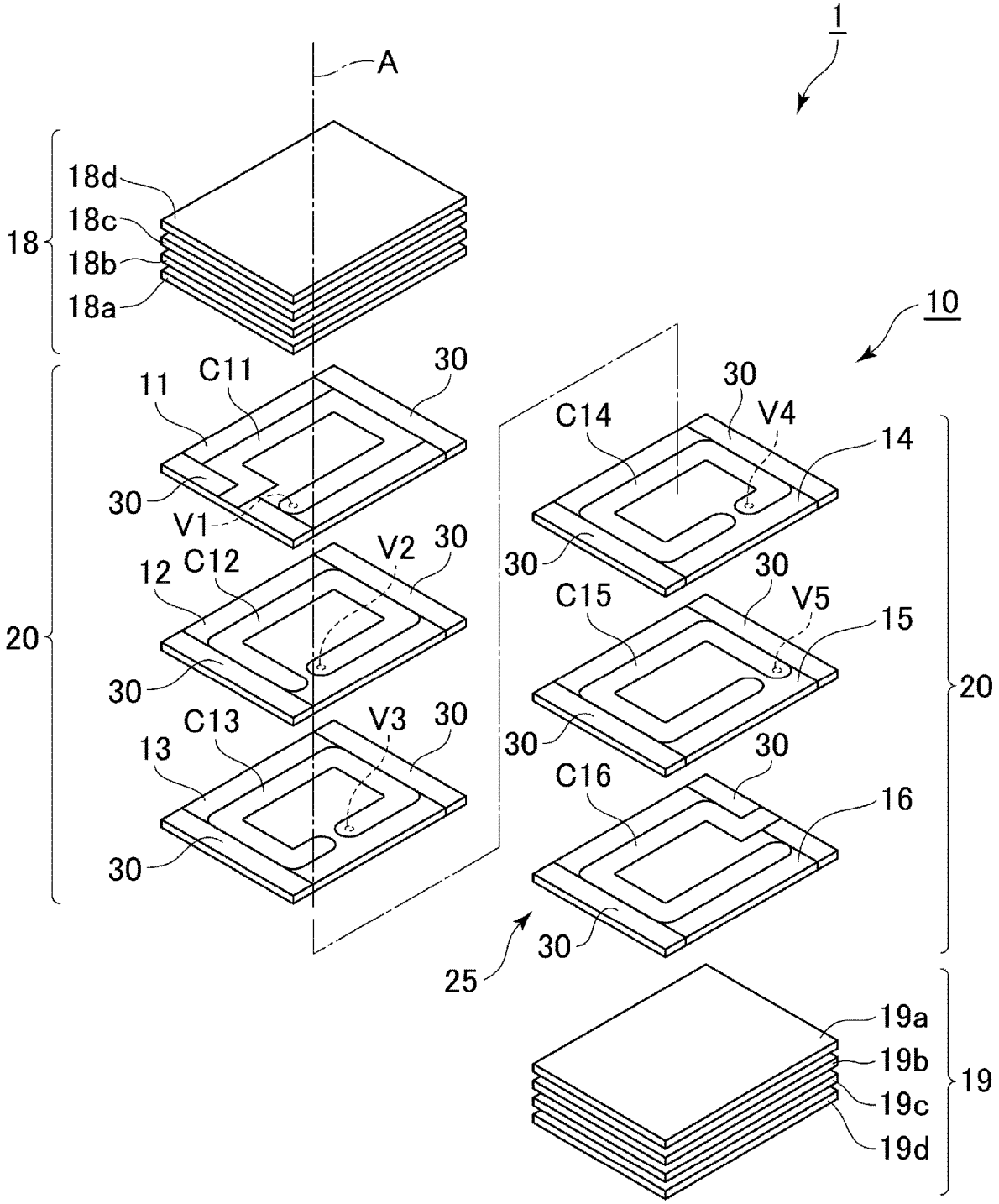
FIG. 2 is an exploded perspective view of the coil component shown in FIG. 1.

FIG. 1 is a perspective view of a coil component 1 according to one embodiment of the present invention, and FIG. 2 is an exploded perspective view of the coil component 1 shown in FIG. 1. By way of one example of the coil component 1, FIGS. 1 and 2 show a laminated inductor used as a passive element in various circuits. The laminated inductor is one example of a laminated coil component to which the present invention is applicable. The present invention is applicable to a power inductor incorporated in a power source line and to various other coil components.

The coil component 1 according to the embodiment shown includes a laminate (base body) 10, conductor patterns C11 to C16 embedded in the laminate 10, an external electrode 21 electrically connected to one end of the conductor pattern (first conductor pattern) C11, and an external electrode 22 electrically connected to one end of the conductor pattern (second conductor pattern) C16. The laminate (base body) 10 includes a magnetic portion containing metal magnetic particles and an insulator 30 having a higher insulation quality than the magnetic portion. The magnetic portion 10 is a laminate of magnetic layers each made of a magnetic material. The plurality of conductor patterns C11 to C16 extend along the planar direction perpendicular to the coil axis A and are separated from each other in the direction of the coil axis A. The conductor patterns C11 to C16 are each electrically connected to an adjacent one of these conductor patterns via the vias V1 to V5 (described later), and the conductor patterns C11 to C16 connected together in this manner constitute a coil conductor 25. The conductor pattern C11 is connected to the external electrode 21, and the conductor pattern C16 is connected to the external electrode 22.

As shown, in one embodiment of the present invention, the laminate 10 is formed in a substantially rectangular parallelepiped shape. The laminate 10 has a first principal surface 10*e*, a second principal surface 10*f*, a first end surface 10*a*, a second end surface 10*c*, a first side surface 10*b*, and a second side surface 10*d*. The outer surface of the laminate 10 is defined by these six surfaces. The first principal surface 10*e* and the second principal surface 10*f* are opposed to each other, the first end surface 10*a* and the second end surface 10*c* are opposed to each other, and the first side surface 10*b* and the second side surface 10*d* are opposed to each other. In a case where the laminate 10 is formed in a rectangular parallelepiped shape, the first principal surface 10*e* and the second principal surface 10*f* are parallel to each other, the first end surface 10*a* and the second end surface 10*c* are parallel to each other, and the first side surface 10*b* and the second side surface 10*d* are parallel to each other.

In the embodiment of FIG. 1, the first principal surface 10*e* lies on a top side of the laminate 10, and therefore it may be herein referred to as "the top surface." Similarly, the second principal surface 10*f* may be referred to as "the bottom surface." In the coil component 1, the second principal surface 10*f* is opposed to a circuit board (not shown), and therefore, it may be herein referred to as "the mounting surface." The top-bottom direction of the coil component 1 is based on the top-bottom direction in FIG. 1.

In this specification, a "length" direction, a "width" direction, and a "thickness" direction of the coil component 1 are referred to as an "L axis" direction, a "W axis" direction, and a "T axis" direction in FIG. 1, respectively, unless otherwise construed from the context. The L axis, the W axis, and the T axis are perpendicular to one another. The coil axis A extends in the T axis direction. The direction in which the plane including the W axis direction and the L axis direction extends is the planar direction.

In one embodiment of the present invention, the coil component 1 has a length (the dimension in the L axis direction) of 0.2 to 6.0 mm, a width (the dimension in the W axis direction) of 0.1 to 4.5 mm, and a thickness (the dimension in the T axis direction) of 0.1 to 4.0 mm. These dimensions are mere examples, and the coil component 1 to which the present invention can be applied can have any dimensions that conform to the purport of the present invention. In one embodiment, the coil component 1 has a low profile. For example, the coil component 1 has a width larger than the thickness thereof.

FIG. 2 is an exploded perspective view of the coil component 1 shown in FIG. 1. In FIG. 2, the external electrode 21 and the external electrode 22 are omitted for convenience of illustration. As shown, the magnetic portion of the laminate 10 includes a body portion 20, a top cover layer 18 provided on the top-side surface of the body portion 20, and a bottom cover layer 19 provided on the bottom-side surface of the body portion 20. The body portion 20 includes magnetic layers 11 to 16 stacked together. The magnetic portion includes the top cover layer 18, the magnetic layer 11, the magnetic layer 12, the magnetic layer 13, the magnetic layer 14, the magnetic layer 15, the magnetic layer 16, and the bottom cover layer 19 that are stacked in this order from the top to the bottom in FIG. 2.

The top cover layer 18 includes four magnetic layers 18*a* to 18*d*. The top cover layer 18 includes the magnetic layer 18*a*, the magnetic layer 18*b*, the magnetic layer 18*c*, and the magnetic layer 18*d* that are stacked in this order from the bottom to the top in FIG. 2.

The bottom cover layer 19 includes four magnetic layers 19*a* to 19*d*. The bottom cover layer 19 includes the magnetic layer 19*a*, the magnetic layer 19*b*, the magnetic layer 19*c*, and the magnetic layer 19*d* that are stacked in this order from the top to the bottom in FIG. 2.

As will be described later, the magnetic layers 11 to 16 have corresponding conductor patterns C11 to C16 embedded therein, respectively. Before the magnetic layers 11 to 16 are stacked together, the top-side surfaces of the conductor patterns C11 to C16 are exposed at the top-side surfaces of the magnetic layers 11 to 16, respectively. The conductor patterns C11 to C16 constitute the coil conductor 25. The coil conductor 25 has a coil axis A. The conductor patterns C11 to C16 are formed to extend around the coil axis A. In the embodiment shown, the coil axis A extends in the T axis direction, which is the same as the lamination direction of the magnetic layers 11 to 16.

In another embodiment of the present invention, the magnetic layers 11 to 16 may be stacked together in the L axis direction. In this case, since the conductor patterns C11 to C16 are formed in the surfaces of the magnetic layers 11 to 16, respectively, the coil axis A is oriented in the L axis direction, which is the same as the lamination direction of the magnetic layers 11 to 16. In still another embodiment of the present invention, the magnetic layers 11 to 16 may be stacked in the W axis direction. In this case, since the conductor patterns C11 to C16 are formed in the surfaces of the magnetic layers 11 to 16, respectively, the coil axis A is oriented in the W axis direction, which is the same as the lamination direction of the magnetic layers 11 to 16.

The resin contained in the magnetic layers 11 to 16, the magnetic layers 18*a* to 18*d*, and the magnetic layers 19*a* to 19*d* is made of an insulating material. In one embodiment, this insulating material is a resin material having an excellent insulation quality. Examples of this resin material include a polyvinyl butyral (PVB) resin, an ethyl cellulose resin, a polyvinyl alcohol resin, and an acrylic resin. The resin contained in the magnetic layers 11 to 16, the magnetic layers 18*a* to 18*d*, and the magnetic layers 19*a* to 19*d* may be a thermosetting resin having an excellent insulation quality. Examples of this thermosetting resin include an epoxy resin, a polyimide resin, a polystyrene (PS) resin, a high-density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, or a polybenzoxazole (PBO) resin. Each of the magnetic layers may contain either the same resin as or a different resin than other magnetic layers.

In a case where the magnetic layers 11 to 16, the magnetic layers 18*a* to 18*d*, and the magnetic layers 19*a* to 19*d* are formed of such a resin material, these magnetic layers may contain filler particles. The filler particles are, for example, particles of a ferrite material, soft magnetic metal particles, particles of an inorganic material such as $SiO_2$ or $Al_2O_3$, or glass-based particles. Particles of a ferrite material applicable to the present invention are, for example, particles of Ni—Zn ferrite or particles of Ni—Zn—Cu ferrite. Soft magnetic metal particles applicable to the present invention are made of a material in which magnetism is developed in an unoxidized metal portion, and such soft magnetic metal particles are, for example, particles including unoxidized metal or alloy particles. Soft magnetic metal particles applicable to the present invention include particles of, for example, an Fe—Si—Cr, Fe—Si—Al, or Fe—Ni alloy, an Fe—Si—Cr—B—C or Fe—Si—B—Cr amorphous alloy, Fe, or a mixture of these materials.

The magnetic layers 11 to 16, the magnetic layers 18*a* to 18*d*, and the magnetic layers 19*a* to 19*d* may be formed by binding together a multitude of soft magnetic metal particles each having an insulating film formed on the surface thereof. The insulating film is, for example, an oxide film formed by oxidizing a surface of a soft magnetic metal. The magnetic layers formed of a multitude of soft magnetic metal particles bound together do not necessarily contain a resin. Soft magnetic metal particles applicable to the present invention include particles of, for example, an Fe—Si—Cr, Fe—Si—Al, or Fe—Ni alloy, an Fe—Si—Cr—B—C or Fe—Si—B—Cr amorphous alloy, Fe, or a mixture of these materials. For example, Japanese Patent Application Publication No. 2013-153119 discloses a structure formed of soft magnetic metal particles that can be used as the magnetic layers 11 to 16, the magnetic layers 18*a* to 18*d*, and the magnetic layers 19*a* to 19*d*.

The coil component 1 can include any number of magnetic layers as necessary in addition to the magnetic layers 11 to 16, the magnetic layers 18*a* to 18*d*, and the magnetic layers 19*a* to 19*d*. Some of the magnetic layers 11 to 16, the magnetic layers 18*a* to 18*d*, and the magnetic layers 19*a* to 19*d* can be omitted as appropriate.

The magnetic layers 11 to 15 are provided with vias V1 to V5, respectively, at predetermined locations therein. The vias V1 to V5 are formed by forming through-holes at the predetermined locations in the magnetic layers 11 to 15, respectively, so as to extend through the magnetic layers 11 to 15 in the T axis direction, and filling a metal material into the through-holes.

The conductor patterns C11 to C16 and the vias V1 to V5 are formed to contain a metal having an excellent electrical conductivity, such as Ag, Pd, Cu, or Al, or any alloy of these metals.

The specific materials mentioned herein are examples, and other suitable materials not mentioned herein can also be used as materials of the constituent elements of the coil component 1.

In one embodiment, the external electrode 21 is provided on the first end surface 10*a* of the laminate 10, and the external electrode 22 is provided on the second end surface 10*c* of the laminate 10. As shown, the external electrode 21 and the external electrode 22 may extend further onto the top surface 10*e*, the bottom surface 10*f*, the first side surface 10*b*, and the second side surface 10*d* of the laminate 10. In this case, the external electrode 21 covers the entirety of the first end surface 10*a* and a part of each of the top surface 10*e*, the bottom surface 10*f*, the first side surface 10*b*, and the second side surface 10*d* of the laminate 10, and the external electrode 22 covers the entirety of the second end surface 10*c* and a part of each of the top surface 10*e*, the bottom surface 10*f*, the first side surface 10*b*, and the second side surface 10*d* of the laminate 10. The shapes of the external electrode 21 and the external electrode 22 are not particularly limited and can be adjusted as appropriate. For example, the external electrode 21 may be L-shaped and cover a part of each of the first end surface 10*a* and the bottom surface 10*f*, or it may be plate-shaped and cover a part of the bottom surface 10*f*. Likewise, the external electrode 22 may be L-shaped and cover a part of each of the second end surface 10*c* and the bottom surface 10*f*, or it may be plate-shaped and cover a part of the bottom surface 10*f*.

Figure 3:
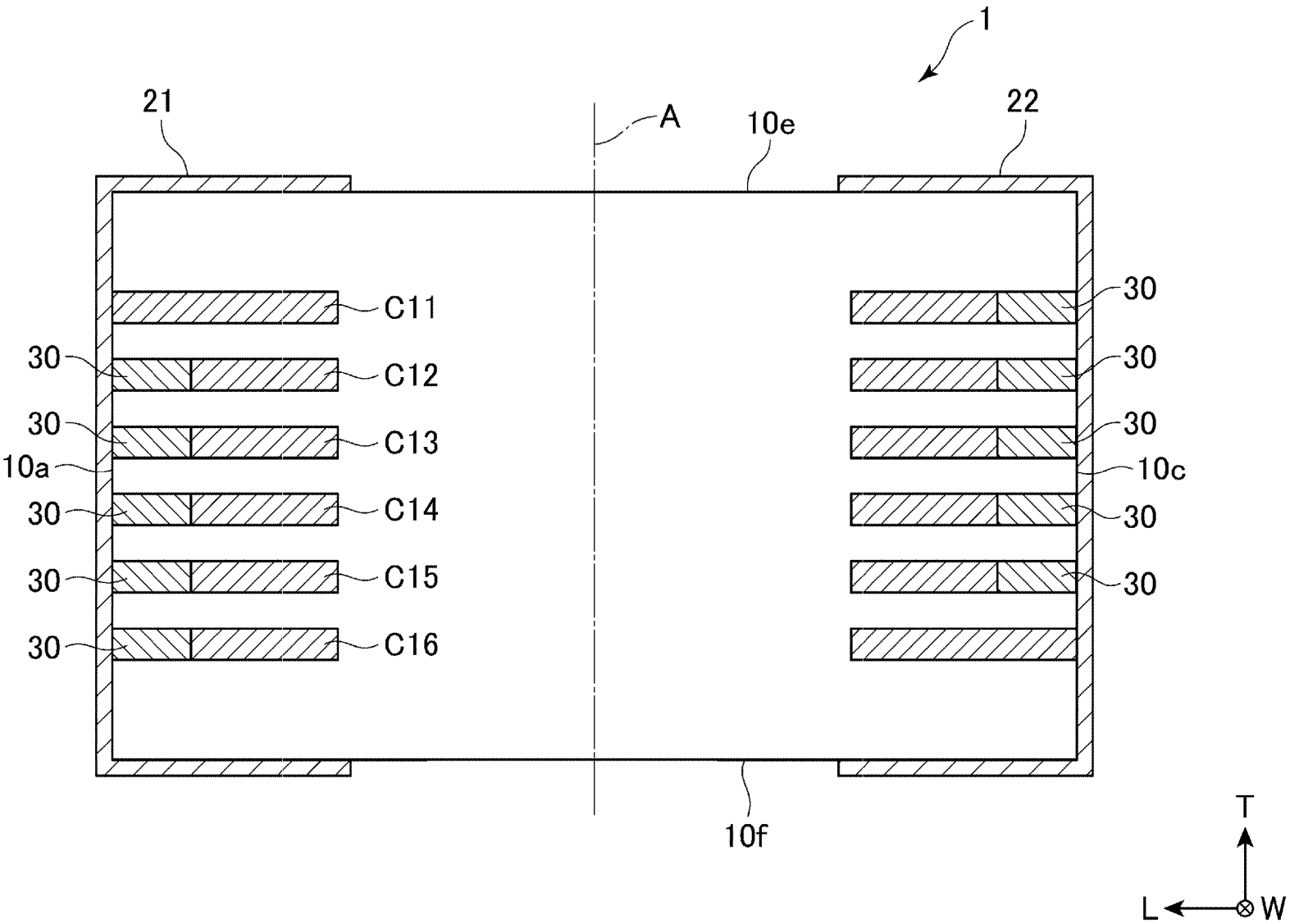
FIG. 3 schematically shows a longitudinal section of the coil component along the line I-I in FIG. 1.
Figure 4:
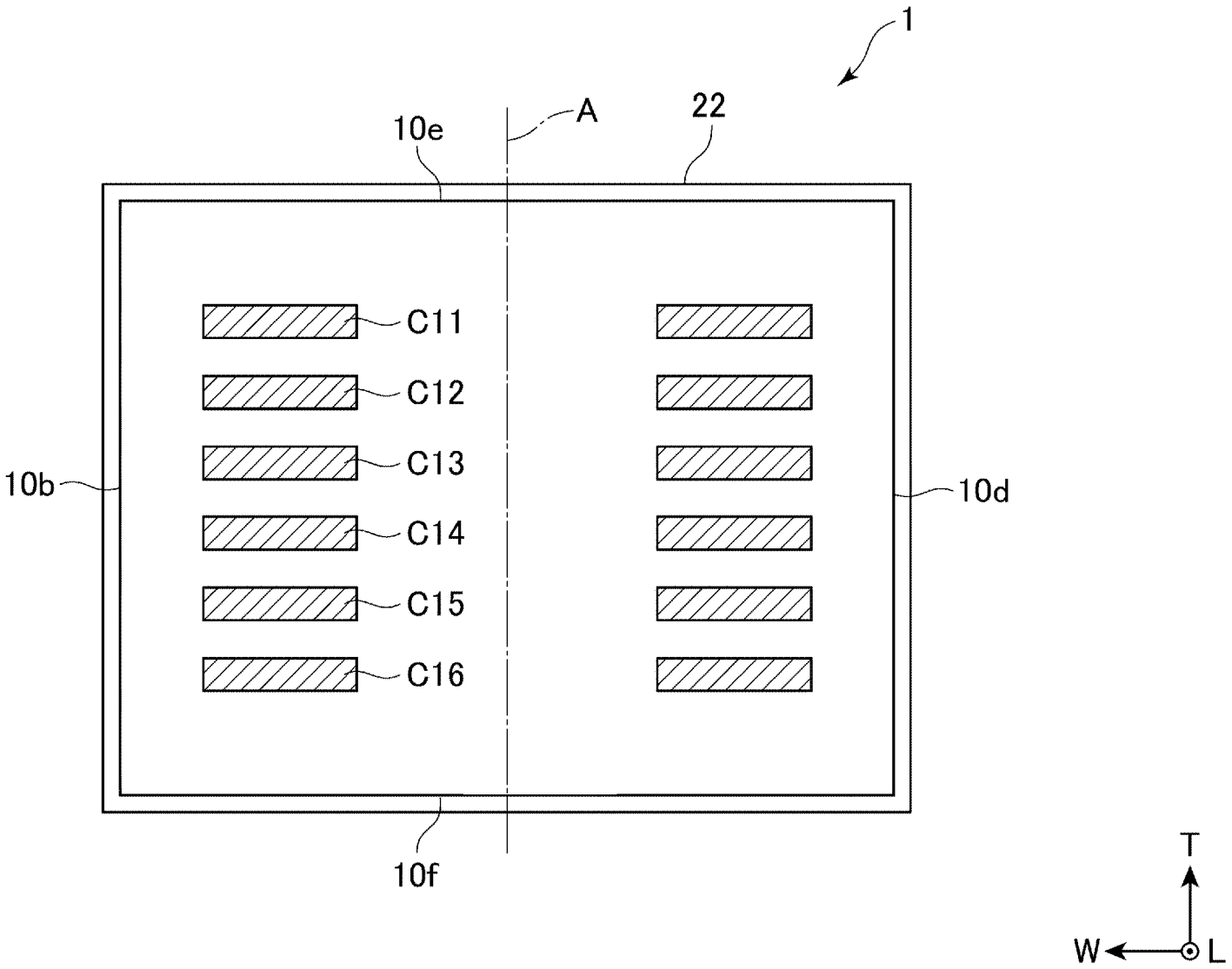
FIG. 4 schematically shows a cross section of the coil component along the line II-II in FIG. 1.
Figure 5:
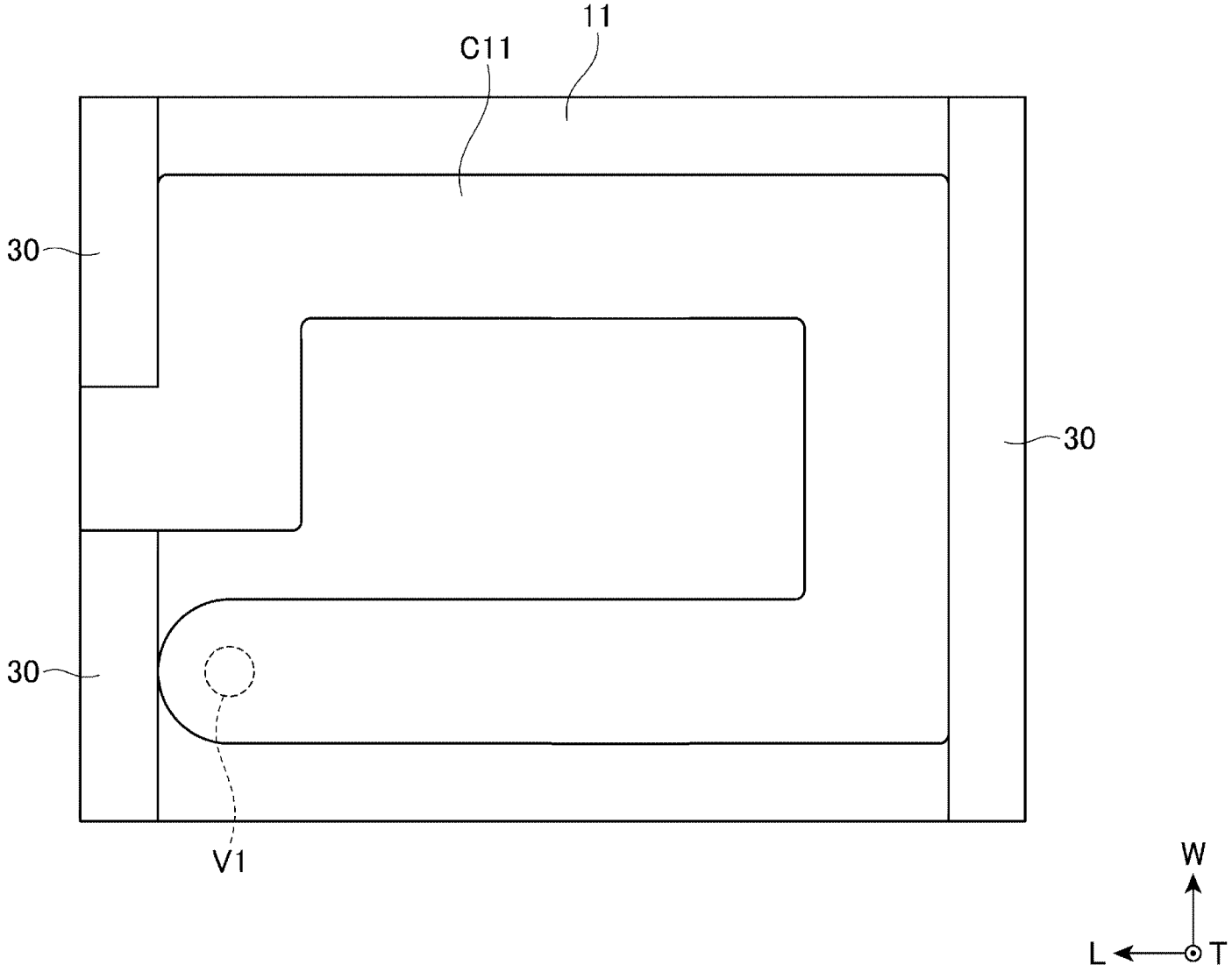
FIG. 5 shows an arrangement of an insulator in the coil component of FIG. 1.

Next, the insulator 30 of the coil component 1 will be described with reference to FIGS. 3 to 5. FIG. 3 schematically shows a longitudinal section of the coil component along the line I-I in FIG. 1. In FIG. 3, the magnetic layers included in the laminate 10 (described later) are omitted. FIG. 4 schematically shows a cross section of the coil component along the line II-II in FIG. 1. FIG. 5 shows an arrangement of the insulator. FIG. 5 is a top view of the magnetic layer 11 and the conductor pattern C11 by way of an example.

The insulator 30 is provided between the external electrode 21 and each of the plurality of conductor patterns C11 to C16 and between the external electrode 22 and each of the plurality of conductor patterns C11 to C16 in the L axis direction within the planar direction perpendicular to the coil axis A. In other words, the insulator 30 is provided in regions where the external electrodes 21, 22 are opposed to the conductor patterns C11 to C16. In the embodiment shown, the insulator 30 is provided between the external electrodes 21, 22 and the conductor patterns C11 to C16 in the direction in which the external electrodes 21, 22 are opposed to each other (the L axis direction in the embodiment shown), and no insulator 30 is provided between the external electrodes 21, 22 and the conductor patterns C11 to C16 in the W axis direction.

The insulator 30 extends from the first side surface 10*b* to the second side surface 10*d* along the first end surface 10*a* or the second end surface 10*c* of the laminate 10. The insulator 30 has a through-hole for leading of the conductor pattern C11 to the external electrode 21. The conductor pattern C11 extends through this through-hole to the external electrode 21, thereby electrically connecting to the external electrode 21. Likewise, the insulator 30 has a through-hole for leading of the conductor pattern C16 to the external electrode 22. The conductor pattern C16 extends through this through-hole to the external electrode 22, thereby electrically connecting to the external electrode 22. The external electrode 21 lies only on the surface of the insulator 30, except for the portion contacting with the conductor pattern C11. Likewise, the external electrode 22 lies only on the surface of the insulator 30, except for the portion contacting with the conductor pattern C16.

In the embodiment shown, the insulator 30 is provided between the external electrodes 21, 22 and all the conductor patterns C11 to C16 in the L axis direction. However, it is only required that the insulator 30 be provided at least between the external electrode 22 and the conductor pattern C11 and between the external electrode 21 and the conductor pattern C16 in the planar direction. In other words, it is not necessary that the insulator 30 be provided between the external electrode 22 and the conductor patterns C12 to C16 and between the external electrode 21 and the conductor patterns C11 to C15. In such an arrangement, a part of the magnetic portion of laminate 10 is interposed between the external electrode 22 and the conductor patterns C12 to C16 and between the external electrode 21 and the conductor patterns C11 to C15.

In the planar direction, the insulator 30 may be either contacted directly with the conductor patterns C11 to C16 or separated from the conductor patterns C11 to C16 with a part of the magnetic portion interposed therebetween. With a part of the magnetic portion interposed between the insulator 30 and the conductor patterns C11 to C16, it is possible to reduce the decrease of the volume of the magnetic portion due to the presence of the insulator 30. Therefore, it is possible to suppress reduction of the saturation flux density and improve the reliability of insulation.

The insulator 30 has a higher insulation quality than the magnetic portion (that is, the magnetic layers 11 to 19*d*). The insulator 30 is formed of, for example, glass, glass mixed with a filler, or a metal magnetic material containing Fe having an oxide film formed by thermal oxidation. The insulator 30 may also be formed of a mixture of the above materials. The volume resistivity of the materials forming the insulator 30 is, for example, equal to or greater than 106 Ω·cm, 107 Ω·cm, 108 Ω·cm, or 109 Ω·cm.

An example of a method of producing the coil component 1 will now be described. The first step is to form a top laminate, an intermediate laminate, and a bottom laminate. The top laminate will constitute the top cover layer 18, and the bottom laminate will constitute the bottom cover layer 19. The top laminate is formed by stacking together a plurality of magnetic sheets that will constitute the magnetic layers 18*a* to 18*d*. Likewise, the bottom laminate is formed by stacking together a plurality of magnetic sheets that will constitute the magnetic layers 19*a* to 19*d*. These magnetic sheets are formed by applying a slurry to a surface of a plastic base film, drying the slurry, and cutting the dried slurry to a predetermined size. The slurry is prepared by, for example, adding a solvent to a resin material containing filler particles. The resin material having the filler particles dispersed therein may be, for example, a polyvinyl butyral (PVB) resin, an epoxy resin, or any other resin materials having an excellent insulation quality.

The intermediate laminate is formed by stacking together a plurality of sheets each including a conductor pattern, a magnetic layer, and an insulator. In producing each sheet, a green sheet is first formed on a base film. The green sheet has a through-hole extending through the green sheet in the lamination direction and configured to receive a via formed therein. Next, the conductor pattern is formed on the green sheet by screen printing or any other method. At this time, the metal material that forms the conductor pattern is filled into the through-hole to form the via. Next, the insulator 30 is formed in a predetermined location corresponding to the conductor pattern by screen printing or any other method. The magnetic layer is then printed where the conductor pattern and the insulator 30 are not formed. After the sheets including the conductor patterns C11 to C16 are formed, the base film is removed, and the sheets are stacked together in the order from the sheet including the conductor pattern C16 to the sheet including the conductor pattern C11. Since there is no conductor pattern below the conductor pattern C16, the sheet including the conductor pattern C16 may not have a through-hole for forming the via.

Next, the intermediate laminate formed in the above-described manner is sandwiched between the top laminate on the top side and the bottom laminate on the bottom side, and the top laminate and the bottom laminate are bonded to the intermediate laminate by thermal compression to obtain a body laminate. Next, the body laminate is diced into pieces of a desired size using a cutter such as a dicing machine or a laser processing machine to obtain chip laminates corresponding to the laminate 10. Next, the chip laminate is degreased and then heated. Next, a conductive paste is applied to the both end portions of the heated chip laminate to form the external electrode 21 and the external electrode 22. The coil component 1 is thus obtained.

As described above, the coil component 1 includes the insulator 30 provided between the external electrode 21 and each of the plurality of conductor patterns C11 to C16 and between the external electrode 22 and each of the plurality of conductor patterns C11 to C16 in the L axis direction within the planar direction perpendicular to the coil axis A. Since the insulator 30 has a higher insulation quality than the magnetic portion, it is possible to prevent or suppress the short circuits between the external electrode 21 and the conductor patterns C11 to C16 and between the external electrode 22 and the conductor patterns C11 to C16.

In the planar direction, the insulator 30 may be provided only in the regions between the external electrode 22 and the conductor pattern C11 contacting with the external electrode 21 and between the external electrode 21 and the conductor pattern C16 contacting with the external electrode 22. In coil component 1, the potential difference is largest between the external electrode 22 and the conductor pattern C11 and between the external electrode 21 and the conductor pattern C16, and therefore, the short circuit is most likely to occur between the external electrode 22 and the conductor pattern C11 and between the external electrode 21 and the conductor pattern C16. As described above, the insulator 30 having a higher insulation quality than the magnetic portion is provided between the external electrode 22 and the conductor pattern C11 and between the external electrode 21 and the conductor pattern C16, thereby improving the reliability of insulation. Further, as described above, the insulator 30 may be provided only in the regions where the short circuit is likely to occur through the magnetic portion, thereby suppressing the reduction of the saturation flux density due to the decrease of the volume of the magnetic portion of laminate 10.

In the planar direction, the insulator 30 may be provided between the external electrode 21 and some of the conductor patterns including the conductor pattern C11, or more preferably between the external electrode 21 and all of the conductor patterns C11 to C16, and between the external electrode 22 and some of the conductor patterns including the conductor pattern C16, or more preferably between the external electrode 22 and all of the conductor patterns C11 to C16. This arrangement also increases the insulation quality between the external electrodes 21, 22 and some or all of the conductor patterns C12 to C15 besides the conductor pattern C11 and the conductor pattern C16, thereby further improving the reliability of insulation.

Figure 6:
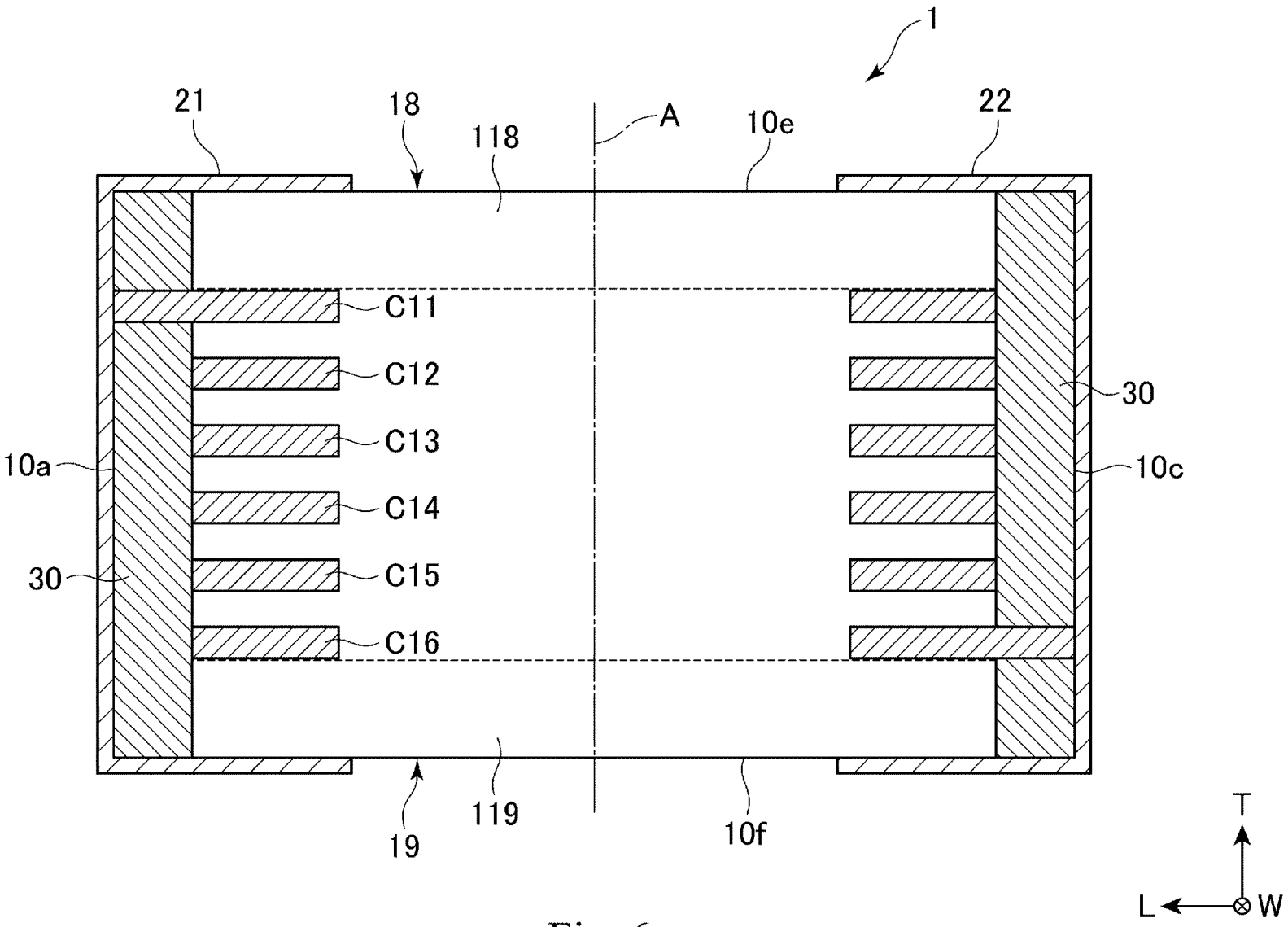
FIG. 6 schematically shows a longitudinal section of a coil component according to another embodiment of the present invention.

Next, another embodiment of the invention will be described with reference to FIG. 6. FIG. 6 is a sectional view of the coil component according to the other embodiment cut along the plane corresponding to the longitudinal section of the FIG. 3. In the embodiment shown in FIG. 6, the magnetic portion of the laminate 10 includes a body portion 20, a top cover portion 118 provided on the top-side surface of the body portion 20, and a bottom cover portion 119 provided on the bottom-side surface of the body portion 20. Both the top cover portion 118 and the bottom cover portion 119 are formed of a magnetic material. As shown in FIG. 6, the insulator 30 may extend from the first principal surface 10*e* to the second principal surface 10*f* of the laminate 10. In other words, the magnetic portion includes interposing regions disposed between the conductor patterns adjacent to each other in the direction of the coil axis A, and the insulator 30 is provided between the interposing regions and the external electrodes 21, 22 in the planar direction. In the planar direction, the insulator 30 is also provided in the regions between the top cover portion and the external electrodes 21, 22 and between the bottom cover portion and the external electrodes 21, 22. In the embodiment shown in FIG. 6, the top cover layer 18 is formed of the top cover portion 118 and the insulator 30 provided on both sides of the top cover portion 118 in the direction in which the external electrodes 21, 22 are opposed to each other (i.e. in the L axis direction). Likewise, the bottom cover layer 19 is formed of the bottom cover portion 119 and the insulator 30 provided on both sides of the bottom cover portion 119 in the L axis direction. According to this embodiment, it is possible to further suppress the short circuit occurring between the coil conductor 25 and the external electrodes 21, 22 via the laminate 10.

Figure 7:
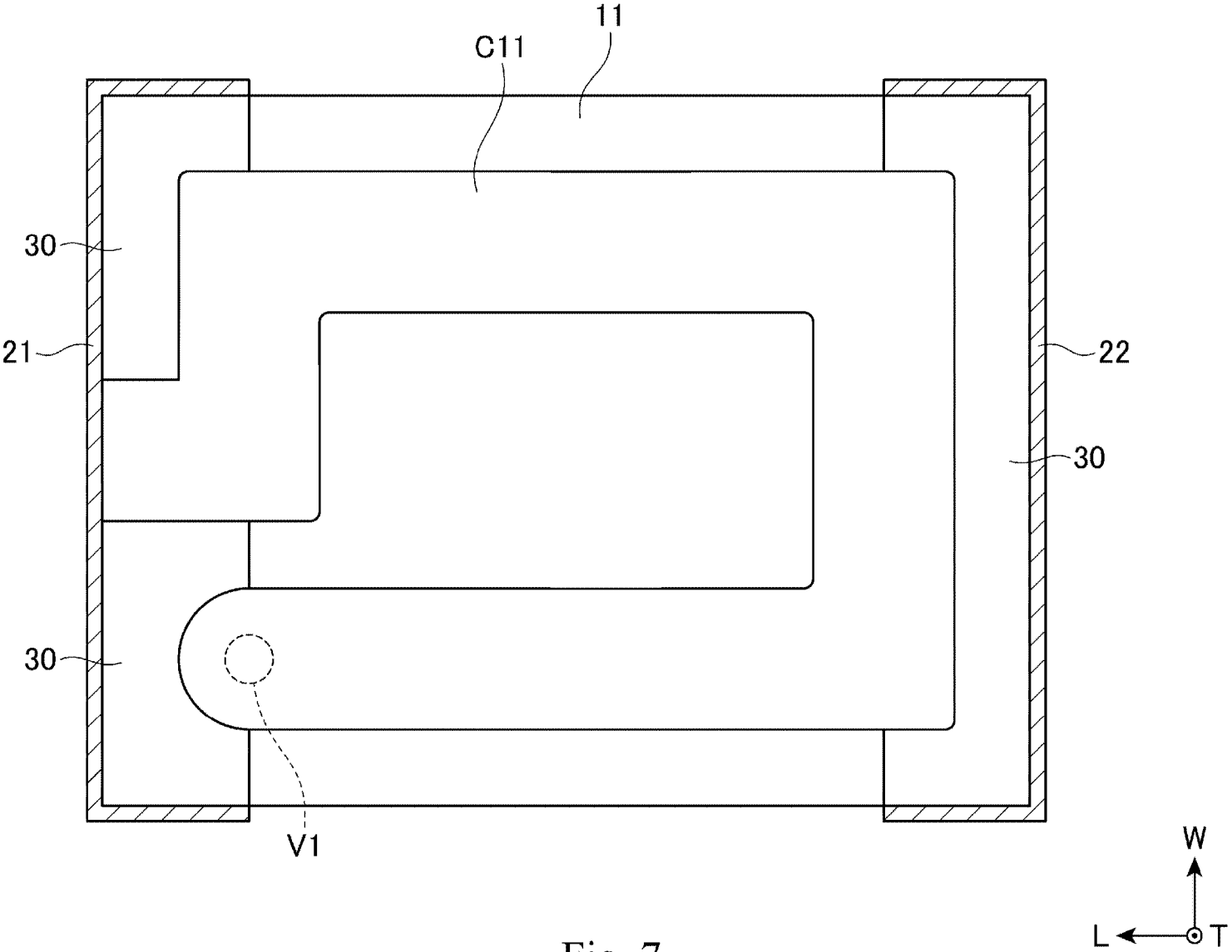
FIG. 7 shows an arrangement of the insulator in another embodiment of the present invention.

Next, another embodiment of the invention will be described with reference to FIG. 7. FIG. 7 shows an arrangement of the insulator in a coil component according to the other embodiment of the present invention. In the embodiment shown in FIG. 7, the insulator 30 is also provided in the regions between the external electrodes 21, 22 and the conductor patterns C11 to C16 in the W axis direction, as well as in the L axis direction. This arrangement makes it possible to prevent or suppress the short circuit occurring between the coil conductor 25 and the portions of the external electrodes 21, 22 extending along the first side surface 10*b* and the second side surface 10*d*.

Figure 8:
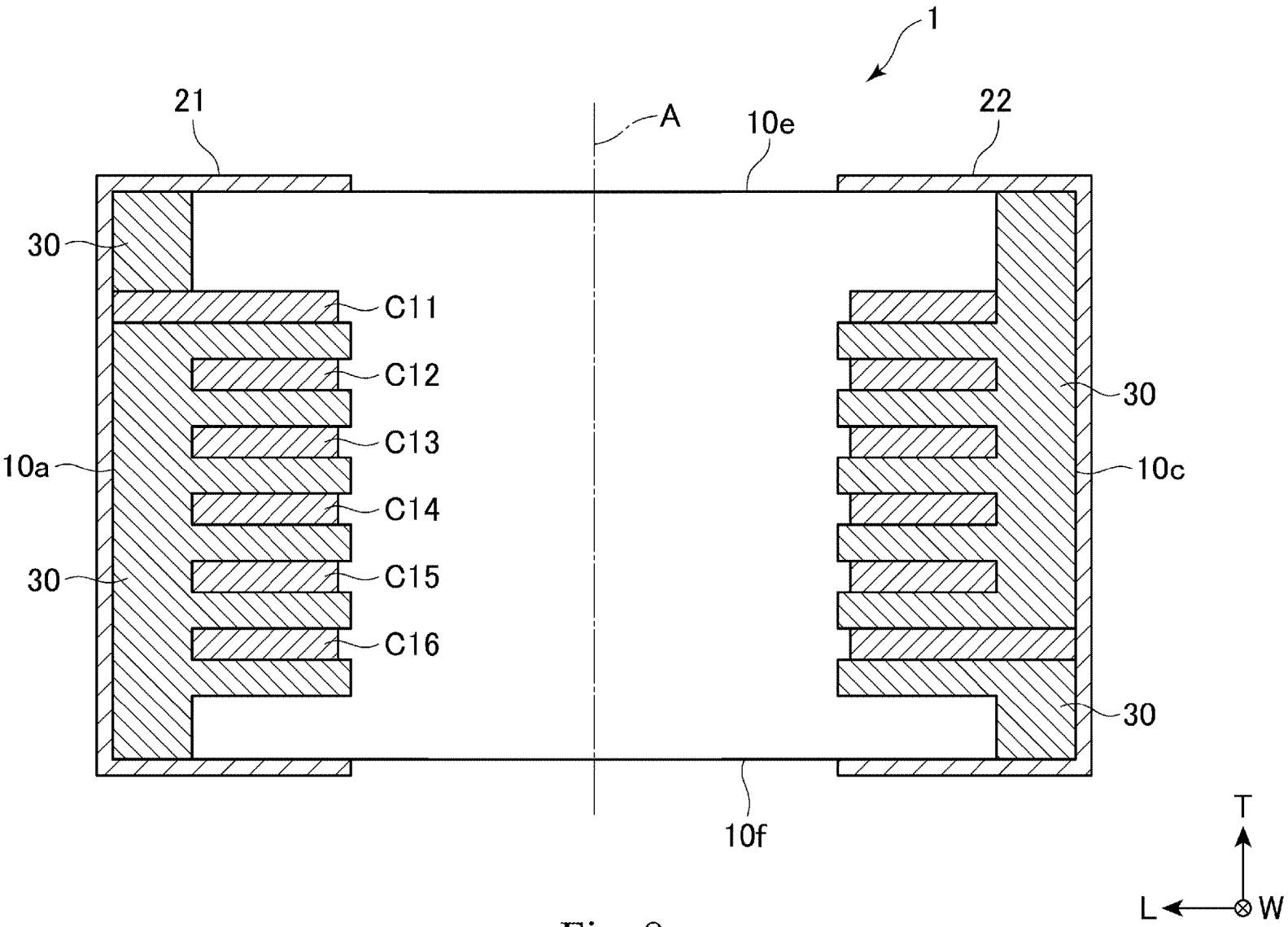
FIG. 8 shows an arrangement of the insulator in another embodiment of the present invention.

Next, another embodiment of the invention will be described with reference to FIG. 8. FIG. 8 shows an arrangement of the insulator in a coil component according to the other embodiment of the present invention. In the embodiment shown in FIG. 8, the insulator 30 is also provided in the regions between the conductor patterns C11 to C16 in the direction of the coil axis A (i.e., the T axis direction). In the embodiment shown, the ends of the insulator 30 are positioned closer to the coil axis A than are the ends of the conductor patterns C11 to C16 in the L axis direction. The position of the ends of the insulator 30 and the position of the ends of the conductor patterns C11 to C16 may be substantially the same in the L axis direction. Since there is no conductor pattern below the conductor pattern C16, no insulator 30 may be provided directly below the conductor pattern C16. This arrangement of the insulator 30 makes it possible to prevent or suppress the short circuit occurring between adjacent conductor patterns via the magnetic portion, thereby further improving the reliability of insulation in the coil component 1.

A description is given of a method of producing the coil component having the insulator 30 arranged as described above. The first step is to form a top laminate, an intermediate laminate, and a bottom laminate. The top laminate will constitute the top cover layer 18, and the bottom laminate will constitute the bottom cover layer 19. The method of producing the top laminate and the bottom laminate is the same as for the coil component shown in FIG. 3.

The intermediate laminate is formed by stacking together a plurality of sheets each including a conductor pattern, a magnetic layer, and an insulator. In producing each sheet, the material that forms the insulator 30 is first printed on the base film in a pattern corresponding to the conductor pattern by screen printing or any other method. This forms a part of the insulator 30 that will be disposed between the conductor patterns when the sheets are stacked together. Next, the conductor pattern is formed by screen printing or any other method. Next, the material that forms the insulator 30 is printed again to form the insulator 30 between the conductor pattern and the external electrodes in the planar direction. The magnetic layer is then printed where the conductor pattern and the insulator 30 are not formed. After the sheets including the conductor patterns C11 to C16 are formed, the base film is removed, and the sheets are stacked together in the order from the sheet including the conductor pattern C16 to the sheet including the conductor pattern C11. Since there is no conductor pattern below the conductor pattern C16, the bottommost sheet including the conductor pattern C16 may be produced using a green sheet as in the method of producing the coil component shown in FIG. 3.

Next, the intermediate laminate formed in the above-described manner is sandwiched between the top laminate on the top side and the bottom laminate on the bottom side, and the top laminate and the bottom laminate are bonded to the intermediate laminate by thermal compression to obtain a body laminate. Next, the body laminate is diced into pieces, and then the external electrodes 21, 22 are formed. Through these steps, the coil component shown in FIG. 8 is obtained. It is also possible to use various other methods such as the slurry building process to produce the coil component.

The dimensions, materials, and arrangements of the constituent elements described herein are not limited to those explicitly described for the embodiments, and these constituent elements can be modified to have any dimensions, materials, and arrangements within the scope of the present invention. Furthermore, constituent elements not explicitly described herein can also be added to the described embodiments, and it is also possible to omit some of the constituent elements described for the embodiments.

What is claimed is:

1. A coil component, comprising:

a base body including a magnetic portion and an insulator, the magnetic portion containing metal magnetic particles, the insulator having a higher insulation quality than the magnetic portion;

a first external electrode provided on a surface of the base body;

a second external electrode provided on the surface of the base body; and a coil conductor wound around a coil axis in the base body, wherein the insulator includes a first insulation portion and a second insulation portion, wherein the coil conductor includes a plurality of conductor patterns each extending along a planar direction perpendicular to the coil axis, and the plurality of conductor patterns are separated from each other in the direction of the coil axis, wherein the plurality of conductor patterns include a first conductor pattern, a second conductor pattern, and a plurality of other conductor patterns disposed between the first conductor pattern and the second conductor pattern in the direction of the coil axis, the plurality of other conductor patterns separated from each other in the direction of the coil axis, wherein the first conductor pattern contacts—with the first external electrode, and the second conductor pattern contacts with the second external electrode, wherein in the planar direction, the first insulation portion is provided between the first conductor pattern and the second external electrode at a region where a short circuit is most likely to occur, and wherein in the planar direction, the second insulation portion is provided between the second conductor pattern and the first external electrode at a region where a short circuit is most likely to occur.

2. The coil component of claim 1, wherein the insulator includes a third insulation portion and a fourth insulation portion, wherein in the planar direction, the third insulation portion is provided between the first external electrode and each of the plurality of other conductor patterns at a region where a short circuit is most likely to occur, and wherein in the planar direction, the fourth insulation portion is provided between the second external electrode and each of the plurality of other conductor patterns at a region where a short circuit is most likely to occur.

3. The coil component of claim 1, wherein the insulator includes a fifth insulation portion and a sixth insulation portion, wherein in the planar direction, the fifth insulation portion is provided between the magnetic portion and the first external electrode, and wherein in the planar direction, the sixth insulation portion is provided between the magnetic portion and the second external electrode.

4. The coil component of claim 3, wherein the magnetic portion includes interposing regions disposed between adjacent ones of the plurality of conductor patterns in the direction of the coil axis, and wherein the insulator includes a seventh insulation portion and an eighth insulation portion, wherein in the planar direction, the seventh insulation portion is provided between the first external electrode and each of the interposing regions, and wherein in the planar direction, the eighth insulation portion is provided between the second external electrode and each of the interposing regions.

5. The coil component of claim 3, wherein the magnetic portion includes a first cover portion and a second cover portion, the first cover portion is disposed on one side of the coil conductor in the direction of the coil axis, and the second cover portion is disposed on the other side of the coil conductor in the direction of the coil axis, wherein in the planar direction, the fifth insulation portion is provided between the first cover portion and the first external electrode and between the second cover portion and the first external electrode, and wherein in the planar direction, the sixth insulation portion is provided between the first cover portion and the second external electrode and between the second cover portion and the second external electrode.

6. The coil component of claim 1, wherein the insulator includes a ninth insulation portion, and wherein the ninth insulation portion is provided between each pair of adjacent ones of the plurality of conductor patterns in the direction of the coil axis.

7. The coil component of claim 1, wherein the first external electrode lies only on a surface of the insulator, except for a portion of the first external electrode contacting with the first conductor pattern, and wherein the second external electrode lies only on the surface of the insulator, except for a portion of the second external electrode contacting with the second conductor pattern.

8. The coil component of claim 1, wherein in the planar direction, a part of the magnetic portion is interposed between the insulator and the plurality of conductor patterns.

9. The coil component of claim 1, wherein the first insulation portion contacts with the second external electrode, and the second insulation portion contacts with the first external electrode.

* * * * *